US010077522B2

(12) United States Patent
Oh et al.

(10) Patent No.: US 10,077,522 B2
(45) Date of Patent: Sep. 18, 2018

(54) METHOD FOR CONTROLLING WASHING APPARATUS

(75) Inventors: Youngkee Oh, Changwon-si (KR); Deughee Lee, Changwon-si (KR); Changsik Kim, Changwon-si (KR); Taehyok Kwon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 791 days.

(21) Appl. No.: 14/111,372

(22) PCT Filed: Apr. 26, 2011

(86) PCT No.: PCT/KR2011/003041

§ 371 (c)(1), (2), (4) Date: Dec. 5, 2013

(87) PCT Pub. No.: WO2012/141361

PCT Pub. Date: Oct. 18, 2012

(65) Prior Publication Data

US 2014/0101866 A1 Apr. 17, 2014

(30) Foreign Application Priority Data

Apr. 11, 2011 (KR) ..... 10-2011-0033356

(51) Int. Cl.

| | |
|---|---|
| ***D06F 33/02*** | (2006.01) |
| ***D06F 39/08*** | (2006.01) |
| ***D06F 39/10*** | (2006.01) |
| ***D06F 13/00*** | (2006.01) |

(52) U.S. Cl.

CPC ..... *D06F 33/02* (2013.01); *D06F 13/00* (2013.01); *D06F 39/08* (2013.01); *D06F 39/083* (2013.01); *D06F 39/087* (2013.01); *D06F 39/088* (2013.01); *D06F 39/10* (2013.01)

(58) Field of Classification Search

CPC ..... D06F 33/02; D06F 39/087; D06F 39/08

USPC ..... 8/137

See application file for complete search history.

(56) References Cited

U.S. PATENT DOCUMENTS

| | | | | |
|---|---|---|---|---|
| 4,417,457 | A | 11/1983 | Brenner | |
| 4,420,952 | A | 12/1983 | Brenner et al. | |
| 5,018,372 | A | 5/1991 | Altnau, Sr. | |
| 5,167,722 | A * | 12/1992 | Pastryk | D06F 35/006 134/33 |
| 5,595,072 | A | 1/1997 | Bai et al. | |
| 6,402,962 | B1 | 6/2002 | Bruntz et al. | |

(Continued)

FOREIGN PATENT DOCUMENTS

| | | | |
|---|---|---|---|
| CN | 1197865 | A | 11/1998 |
| CN | 1203974 | A | 1/1999 |

(Continued)

*Primary Examiner* — Rita P Adhlakha

(74) *Attorney, Agent, or Firm* — Dentons US LLP

(57) ABSTRACT

The present invention relates to a method for controlling a washing apparatus, and more particularly, to method for controlling a washing apparatus provided with an independently rotatable drum and a pulsator, comprising a step of draining further comprising a plurality of steps of draining a predetermined amount of rinsing water at a time; a middle step of dehydrating; and a step of supplying water, further comprising a plurality of steps of providing a predetermined amount of rinsing water at a time.

20 Claims, 13 Drawing Sheets

(56) References Cited

U.S. PATENT DOCUMENTS

| | | | | |
|---|---|---|---|---|
| 7,017,217 | B2 * | 3/2006 | Johanski | D06F 21/08 8/158 |
| 2006/0042022 | A1 * | 3/2006 | Kim | D06F 37/304 8/159 |
| 2011/0099731 | A1 * | 5/2011 | Im | D06F 33/02 8/137 |
| 2011/0138864 | A1 | 6/2011 | Ahn | |

FOREIGN PATENT DOCUMENTS

| | | | |
|---|---|---|---|
| CN | 1244605 | A | 2/2000 |
| CN | 1782180 | A | 6/2006 |
| CN | 1966811 | A | 5/2007 |
| CN | 101173437 | A | 5/2008 |
| CN | 101397744 | A | 4/2009 |
| CN | 201258413 | Y | 6/2009 |
| CN | 101476231 | A | 7/2009 |
| CN | 101831779 | A | 9/2010 |
| CN | 101851838 | A | 10/2010 |
| CN | 101864657 | A | 10/2010 |
| JP | 1995-255992 | A | 10/1995 |
| JP | 10085482 | A | 4/1998 |
| JP | 2001259282 | A | 9/2001 |
| JP | 2003311085 | A | 11/2003 |
| JP | 2004141394 | A | 5/2004 |
| KR | 100161931 | B1 | 12/1998 |
| KR | 2019990008861 | U | 3/1999 |
| KR | 1020020007670 | A | 1/2002 |
| KR | 1020030066934 | A | 8/2003 |
| KR | 1020040102508 | A | 12/2004 |
| KR | 10-2009-0108858 | A | 10/2009 |
| KR | 1020110001555 | A | 1/2011 |

* cited by examiner

METHOD FOR CONTROLLING WASHING APPARATUS

This application is a National Stage Entry of International Application No. PCT/KR2011/003041, filed Apr. 26, 2011, and claims the benefit of Korean Application No. 10-2011-0033356, filed on Apr. 11, 2011, which are hereby incorporated by reference in their entirety for all purposes as if fully set forth herein.

FIELD

The present invention relates to a method for controlling a washing apparatus.

BACKGROUND

Generally, washing apparatuses may be classified based on a method for loading laundry into top loading type washing apparatuses and front loading type washing apparatuses. Such top loading type washing apparatuses may be classified into rotary drum types having a rotary drum in washing and rinsing courses, pulsator type having a rotary pulsator provided in a drum and drum-and-pulsator type washing apparatuses having a rotary drum and a rotary pulsator.

Out of the top loading type washing apparatuses and front loading type washing apparatuses, rotary drum type washing apparatuses tend to have less wearing of laundry, less water use and lower washing performance than rotary pulsator type washing apparatuses. Out of the top loading type washing apparatuses, rotary pulsator type washing apparatuses tend to cause more washing water use and more wear and tear of the laundry, even with a higher washing performance.

To complement such strengths and weaknesses, a top loading type washing apparatus having a drum and a pulsator is developed. If such a top loading type washing apparatus having both of the drum and the pulsator is controlled to enhance the washing performance, the amount of lint generated by wear and tear of laundry loaded in the top loading type washing machine is likely to increase. If it is controlled to reduce the wear and tear of the laundry, the washing performance is likely to deteriorate disadvantageously. Accordingly, it becomes necessary to invent a method for maximizing the wear and tear of laundry while maintaining the washing performance.

DETAILED DESCRIPTION OF THE INVENTION

Technical Problem

An object of the present invention is to provide a method for controlling a washing apparatus that may remove foreign substances such as lint which can be generated, with no filtering portion provided in a drum.

Another object of the present invention is to provide a washing apparatus that may enhance the washing performance by removing foreign substances such as lint which can be generated in a washing course, and a controlling method for controlling the washing apparatus.

Technical Solution

To achieve these objects and other advantages and in accordance with the purpose of the invention, as embodied and broadly described herein, a method for controlling a washing apparatus comprising a drum and a pulsator which are rotatable independently, the method includes a water drainage step comprising a plurality of steps configured to drain rinsing water by a predetermined amount, respectively; an intermediate spinning step; and a water supply step comprising a plurality of steps configured to supply rinsing water by a predetermined amount, respectively.

Advantageous Effects

According to at least one embodiments of the present invention, the method for controlling the washing apparatus according to the embodiments of the present invention may eliminate the foreign substances generated in the washing process effectively by preventing the foreign substances including lint drained outside the drum from being drawn into the drum again.

Furthermore, the control method according to the embodiments of the present invention may drain or supply a predetermined amount of water in the water drainage step and in the water supply step gradually. In addition, at least one of the pulsator and the drum may be driven in each of the steps provided in the water drainage step and the water supply step and exhaust the foreign substances from the inside of the drum.

BEST MODE

Detailed Description

A configuration of a washing apparatus according to one embodiment of the present invention will be described as follows simply.

Figure 1:
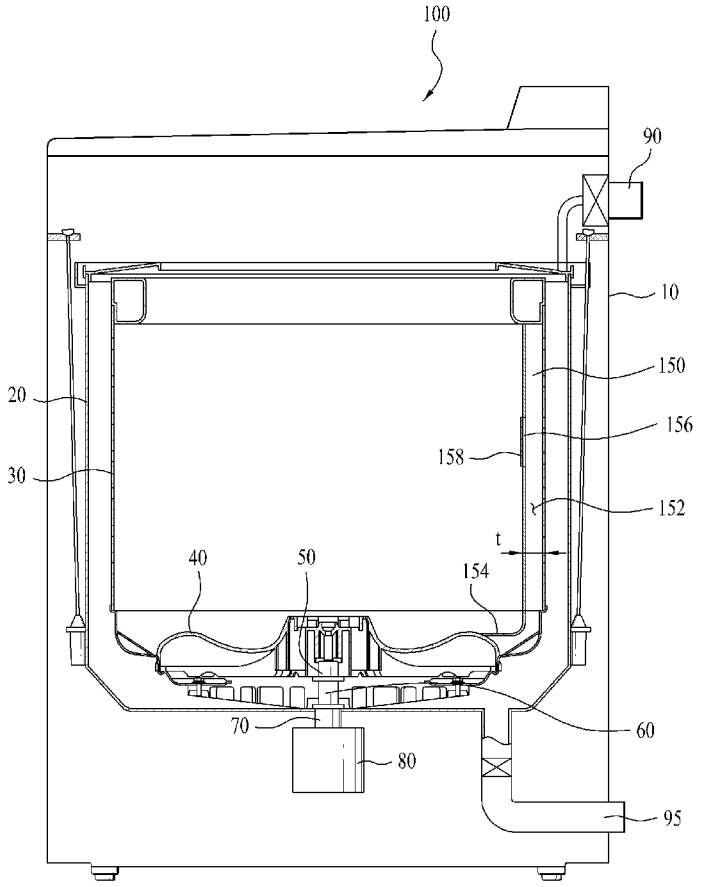
FIG. 1 is a side sectional diagram of a washing apparatus according to one embodiment of the present invention.

As shown in FIG. 1, a washing apparatus 100 according to one embodiment of the present invention mainly includes a cabinet configured to define an exterior thereof, a tub 20 mounted in the cabinet 10 and a drum 30 rotatably provided in the tub 20 to be used for washing and spinning.

In the drum may be provided a pulsator 40 which is rotatable together with the drum 30 or independently with respect to the drum 30. The pulsator 40 is connected to a washing shaft 50 and the washing shaft 50 is coupled to a spinning shaft 60. The washing shaft 50 and the spinning shaft 60 are connected to a motor 80 and they can be rotated by the rotation of the motor 80. A clutch 70 may rotate the washing shaft 50 and the spinning shaft 60 together or independently. In other words, the clutch 70 may rotate the washing shaft 50 to rotate only the pulsator 40, not the drum 30, or it may rotate the spinning shaft 60 to rotate the drum 30 and the pulsator 40 together.

A water supply unit 90 connected to an external water supply source may be provided in an upper portion of the drum 30 and a water drainage pipe 95 for draining washing water may be provided in a lower portion of the tub 20 to be connected outside the cabinet 20. The washing apparatus according to one embodiment is controlled to rotate the drum 30 and/or the pulsator 40 in washing or rinsing for laundry and only the drum in spinning for the laundry.

Meanwhile, a filter unit 150 may be provided in a lateral wall of the drum 30.

Specifically, the filter unit 150 may be provided along a lateral wall of the drum 30 and the filter unit 150 may include a circulation path 152 to circulate washing water there through. In addition, the filter unit 150 may include an inlet 154 formed in a lower portion thereof to draw washing water therein and an outlet 156 formed in a central portion thereof to exhaust the washing water. The filter unit 150 may include a filtering portion 158 provided in the outlet 156 to filter the washing water, such that the washing water drawn into the filter unit 150 from the lower portion of the drum 30 may flow upward along the circulation path 152 according to the rotation of the drum 30 to be supplied to the inside of the drum 30 via the filtering portion 158.

However, the tub 20 is provided outside the drum 30 in the washing apparatus mentioned above and the filter unit 150 may be projected toward the inside of the drum 30 accordingly. In other words, as shown in FIG. 1, the filter unit 150 may be projected toward the inside of the drum 30 as far as a predetermined thickness (t). When the filter unit 150 is projected toward the inside of the drum 30, there might be friction and collision between washing objects including laundry and the filter unit 150 during the rotation of the drum 30. As a result, wear and tear could be caused in the laundry and a lot of foreign substances including link could be generated. Also, there could be damage to fabric of clothes and it may accompany another disadvantage that a laundry loading space inside the drum 30 is reduced as much as a predetermined volume corresponding to the projected area of the filter unit 150.

A washing apparatus and a control method thereof according to embodiments which will be described as follows may suppose that a drum rotatable with respect to a vertical shaft, with no filter unit provided in the drum. Accordingly, the foreign substances including lint and the damage to fabric of laundry, which are generated by the wear and tear of laundry caused by the filter unit projected along the lateral wall of the drum, may be prevented. However, no filter unit is provided in the drum and a predetermined structure configured to exhaust foreign substances including lint generated from the laundry in a washing or rinsing cycle can be provided. The structure of the drum and a control method of the drum which can remove foreign substances therein, with no filter unit, will be described as follows.

Figure 2:
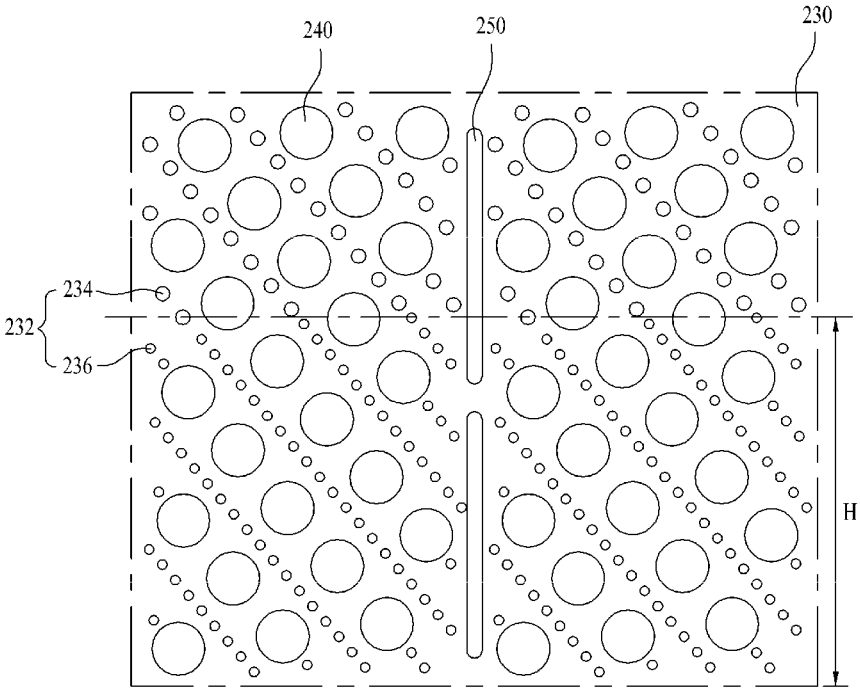
FIG. 2 is a plane diagram partially illustrating a drum provided in a washing apparatus according to a second embodiment of the present invention.

FIG. 2 is a plane diagram partially illustrating a drum provided in a washing apparatus according to a second embodiment of the present invention. A drum provided in the washing apparatus according to this embodiment will be limitedly described as follows. Meanwhile, the washing apparatus according to this embodiment may not include the filter unit provided in the drum as mentioned above and differences from the washing apparatus and the control method according to the embodiment described above will be described as a central figure.

Referring to FIG. 2, the washing apparatus according to this embodiment may include a drum 230 which is rotatable with respect to a vertical shaft. Accordingly, a user may open a door (not shown) provided in a top of the cabinet and load laundry down into the drum 230 from a top.

Meanwhile, the drum 230 provided in the washing apparatus may include a plurality of through holes 232. especially, in the drum 230 provided in the washing apparatus according to this embodiment, a penetration rate of an upper portion and a penetration rate of a lower portion may be different from each other with respect to a predetermined height (H). The term of 'penetration rate' used in the specification may be defined as the size of an object capable of penetrating a through hole formed in the drum. For example, if it is said that the penetration rate is high, it means that the size of an object capable of penetrating one through hole is large. If it is said that the penetration rate is low, it means that the size of the object capable of penetrating the through hole is small. In addition, if it is said that the penetration rate is high, the size of the through hole is large. If it is said that the penetration rate is low, the size of the through hole is small. Accordingly, the means for the penetration rates of the upper and lower portions to be different from each other with respect to the height (H) of the drum 230 may be that the size of the through hole formed in the upper portion is different from that of the through hole formed in the lower portion of the drum 230.

Specifically, the penetration rate of the upper portion may be higher than the penetration rate of the lower portion in the drum 230. For example, the size of a through hole 234 formed in the upper portion of the drum 230 may be larger than the size of a through hole 236 formed in the lower portion of the drum. Accordingly, the sizes of the through holes may be differentiated by the predetermined height (hereinafter, a reference height (H)) of the drum 230 as a boundary.

For example, the size of the through hole 234 formed in the upper portion may be larger than the size of the through hole 236 formed in the lower portion with respect to the reference height (H) of the drum 230. In this instance, the size of the through hole may be set as it will be described as follows. The through hole 234 formed in the upper portion with respect to the reference height may be formed relatively larger, so as to exhaust foreign substances such as lint outside the drum 230 smoothly. However, if the size of the through hole is too large, the strength of the drum 230 could be weakened and it is important to determine the size of the through hole appropriately. For example, the upper through hole 234 may have a diameter of 3.5~4.0 mm in the washing apparatus according to the embodiment and it is preferred that it may have a diameter of 3.7 mm. The lower through hole 236 may be formed relatively smaller than the upper through hole.

Figure 3:
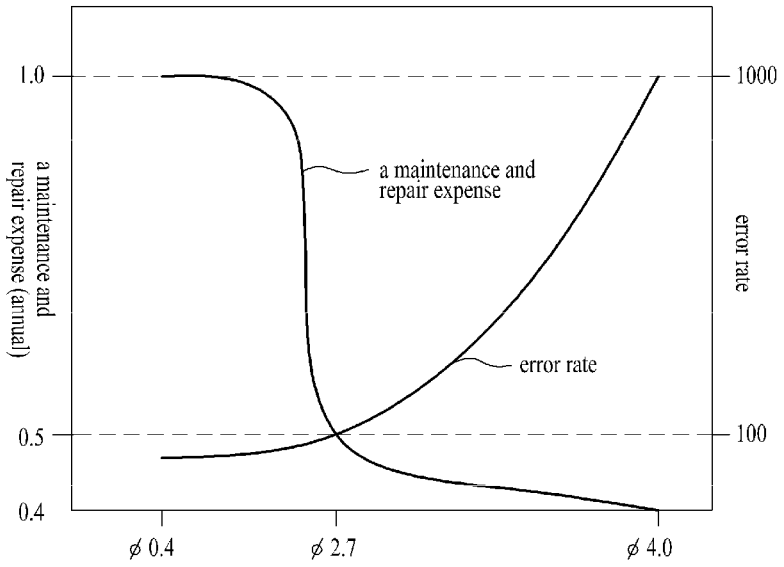
FIG. 3 is a graph illustrating the maintenance and repair expense and the error rate according to the size of a through hole formed in the drum.

FIG. 3 is a graph illustrating the maintenance and repair expense and the error rate according to the size of a through hole formed in the drum. In the graph of FIG. 3, a horizontal axis refers to the size of the through hole and a right vertical axis refers to an error rate. Also, a left vertical axis refers to a maintenance and repair expense. The error rate may be defined as a percentage of errors generated by foreign substances stuck in the through holes (especially, a memory wire contained in the laundry). The maintenance and repair expense may be defined as a maintenance and repair expense per year according to the size of the through hole.

Referring to FIG. 3, as the size of the through hole is getting smaller, foreign substances such as a memory wire is not stuck in the through hole and the error rate is getting lower. In contrast, as the size of the through hole is getting smaller, the annual maintenance and repair expense according to use of the washing apparatus is getting higher. If the size of the through hole is getting larger, more foreign substances such as the memory wire are stuck in the through hole and the error rate is getting higher. However, the annual maintenance and repair expense according to the use of the washing apparatus is getting lower. Accordingly, if searching a value satisfying both of the error rate and the annual maintenance and repair expense appropriately, the value may be in a range of approximately 2.5~3.0 mm. the size of the through hole provided in the lower portion of the drum according to this embodiment may have a range of approximately 2.5~3.0 mm as mentioned above and it is preferred that the size of the through hole is approximately 2.7 mm.

Meanwhile, the reference height (H) for forming the boundary which differentiates the penetration rate of the drum may be set appropriately. For example, the manufacture of washing apparatuses may have information about the most common amount of laundry uses use in a rinsing cycle. For example, manufactures can have the information that the most frequently used amount of the laundry loaded in the rinsing cycle is 5 kg. In case manufactures have such the information, the reference height (H) may be set as a water level corresponding to the most frequently amount of the laundry.

In this instance, once the rinsing cycle starts to perform, the foreign substances separated from the laundry as the drum 230 or the pulsator is rotated may be exhausted outside the drum 230 via the through hole of the drum 230. Especially, the size of the through hole formed in the upper portion with respect to the reference height of the drum is formed relatively larger. When water is circulated by the rotation of the drum or the pulsator, foreign substances provided in an upper portion of the water may be exhausted outside the drum via the upper through hole 234 of the drum smoothly. Moreover, foreign substances are likely to float on the water such that they can be exhausted via the upper through hole of the drum more smoothly. Meanwhile, the lower through hole 236 formed in the lower portion of the drum with respect to the reference height may be formed relatively small and foreign substances cannot penetrate the lower through hole, while the water flow can be performed smoothly. As the size of the through hole is getting smaller as mentioned above, the foreign substances can be prevented from being stuck in the through holes while they are penetrating the holes.

Meanwhile, not dividing the sizes of the through holes with respect to the reference height (H) dichotomously, the sizes of the through holes may be differentiated gradually in a predetermined band of heights including the reference height. That is because the amount of the laundry the user desires to wash is not uniformly set. In other words, when the sizes of the through holes are differentiated dichotomously in case the amount of the laundry the user desires to wash is changed, the laundry cannot reach the reference height and a level of water is lower than the reference height such that the foreign substances inside the drum cannot be exhausted smoothly. That is because the size of the through hole formed in the lower portion of the drum is relatively smaller than that of the through hole formed in the upper portion. Accordingly, if the sizes of the through holes are differentiated gradually in a predetermined band of heights including the reference height (H), the foreign substances inside the drum may be exhausted even with the amount of laundry which can be changed.

Figure 4:
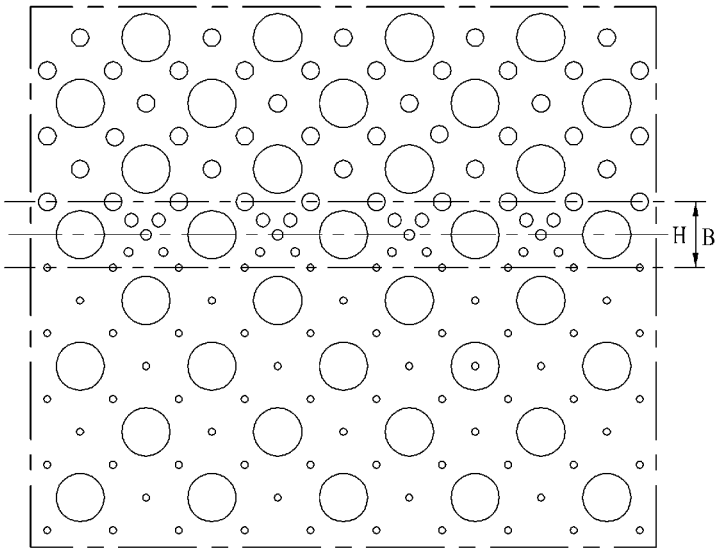
FIG. 4 is a plane diagram partially illustrating a drum according to a third embodiment of the present invention.

FIG. 4 illustrates a third embodiment that the sizes of through holes formed in the drum are differentiated gradually.

Referring to FIG. 4, the sizes of the through holes are differentiated in a predetermined band (B) of heights including the reference height (H) gradually. For example, the sizes of the through holes may be gradually differentiated in a predetermined range of heights higher and lower than the reference height (H), approximately in a range of 2 to 5 cm. In this instance, the sizes of the through holes are formed gradually larger approximately from 2 to 5 cm lower than the reference height. When the sizes of the through holes reach a range of approximately 2 to 5 cm higher than the reference height (H), the sizes are set by a predetermined size.

Meanwhile, referring to FIG. 2 again, the through holes 232 provided along the drum 230 may be inclined, to exhaust foreign substances floating on the water outside the drum smoothly in case the water inside the drum is circulated. In other words, when the drum 230 or the pulsator is rotating, the water inside the drum 230 is flowing and the water positioned in an upper portion is flowing along the rotation direction of the drum or pulsator. As shown in the drawing, the through holes 232 are inclined a predetermined angle in a left direction in the drawing and the drum is rotated in a counter-clockwise direction. In this instance, the water in the upper portion (see the plane view of FIG. 2 seen inside the drum) is flowing along the inclination of the through holes 232 and the foreign substances can be exhausted along the through holes 232 more smoothly.

Figure 5:
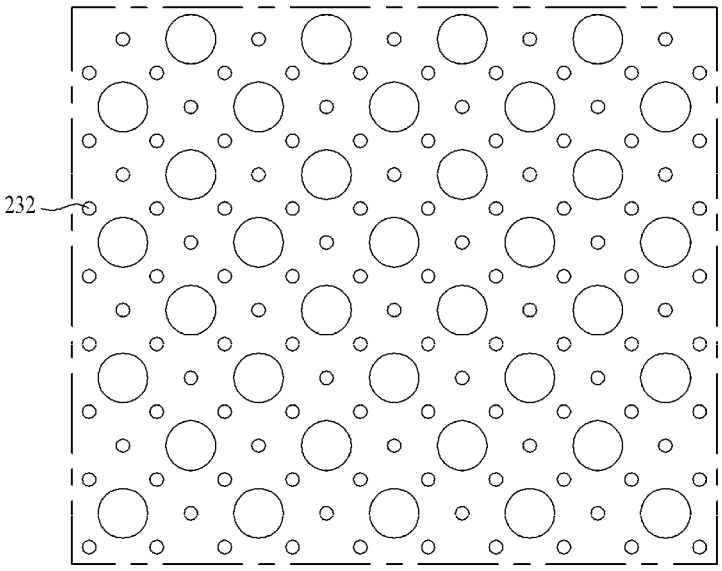
FIG. 5 is a plane diagram partially illustrating a drum according to a fourth embodiment of the present invention.

However, the drum is not rotated only in one direction in the washing and the rinsing cycle but selectively rotated in both directions. Accordingly, if the through holes are inclined in one direction, the foreign substances cannot be smoothly exhausted during the rotation of the drum in both directions. FIG. 5 is a plane diagram partially illustrating a drum according to a fourth embodiment. The drum according to this embodiment may include a plurality of through holes 232 inclined a predetermined angle in both directions, not in one direction. Even when the flowing direction of the water inside the drum is changed by the rotation of the drum in both directions, the foreign substances may be exhausted along the through holes 232 smoothly.

Referring to FIG. 2 again, when the number of the through holes formed higher than the reference height of the drum is compared with the number of the through holes formed lower than the reference height, the number of the through holes formed higher than the reference height may be relatively smaller than the number of the through holes formed lower. That is because the reference height (H) as the boundary between the upper and lower portions is closer to the upper portion of the drum. Also, the size of the upper through holes is larger than that of the lower through holes.

If the upper through holes are larger than the lower through holes, the strength of the drum could weaken.

Meanwhile, a plurality of embossing projections 240 projected toward the inside of the drum may be provided between the through holes of the drum. Such projections are projected a predetermined height toward the inside of the drum. When the drum is rotated, there may be friction between the projections and the laundry and the friction can enhance rinsing performance. If an inner surface of the drum is a smooth surface with no projections and recesses, the friction between the drum and the laundry is hardly generated and the washing and rinsing performance cannot be increased higher than a predetermined value.

Moreover, the drum according to this embodiment may include a rib 250 extended a predetermined length along a vertical direction. The rib 250 may be projected toward the inside of the drum. The rib 250 may be configured to reinforce the strength of the drum and simultaneously to increase the friction with the laundry together with the projections 240 so as to enhance the washing and rinsing performance.

Figure 6:
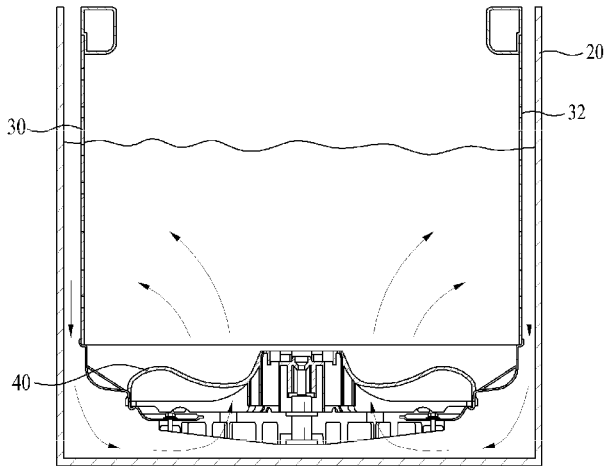
FIG. 6 is a schematic diagram illustrating a flow direction of a washing water or rinsing water in a washing or rinsing cycle.

Meanwhile, FIG. 6 illustrates the flow of washing water or rinsing water according to the rotation of the pulsator 40 in the washing or rinsing cycle. Referring to FIG. 6, the flow of the washing water or rinsing water will be described as follows.

The plurality of the through holes 34 may be provided in the drum 30 and washing water or rinsing water is penetrating the through holes 34 along the rotation of the drum 30. When the pulsator 40 provided in the drum 30 is rotated in a washing or rinsing cycle, water flow is generated from the inside toward the outside of the drum. Such the flow of water is exhausted to a space between the drum 30 and the tub 20 via the through holes 34 provided in the lateral wall of the drum 30, and then downward along the space formed between the drum 30 and the tub 20. The washing water or rinsing water is pumped upward by the rotation of the pulsator 40 in a space between a bottom of the drum 30 and a bottom of the tub 20 and drawn into the drum 30 via holes provided in a lower portion of the drum 30 again. This structure may accompany a disadvantage that the lint generated in the washing or rinsing cycle fails to separate only to be stuck to the laundry. To solve such a disadvantage, the structure of the washing apparatus will be described as follows, referring to the drawings herewith.

Figure 7:
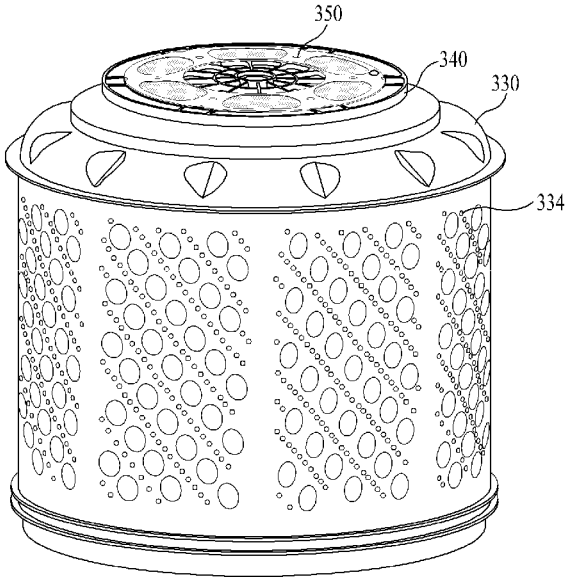
FIG. 7 is a lower perspective diagram of a drum according to a fifth embodiment of the present invention.

FIG. 7 is a perspective diagram illustrating a bottom of a drum according to a fifth embodiment. In FIG. 7, it is shown that the drum is turned over to make the bottom of the drum 330 seen in a top for description convenience sake.

Referring to FIG. 7, the washing apparatus according to this embodiment may include a filter unit 350 provided in a predetermined portion of the rotatable drum 330. Here, the filter unit 350 may be provided in any portions of the drum along a circulation path where washing or rinsing water is circulated in case the pulsator is rotated. In this embodiment, the filter unit 350 may be provided in a predetermined portion of the drum 330 on the circulation path, for example, the bottom of the drum 330. Accordingly, when the washing or rinsing water circulated by the rotating pulsator is drawn via the drum 330 as mentioned above, the filter unit may filter the washing or rinsing water to prevent foreign substances such as lint from being drawn into the drum 330 again. Moreover, a hub 340 may be provided in the bottom of the drum 330 to connect the drum with a driving source such as a motor. Accordingly, the filter unit 350 may be provided between the hub 340 and the drum 330 or the hub 340 is connected to the bottom of the drum 330 and the filter unit 350 may be connected in a bottom of the hub 340. The embodiment that the tub 340 is connected to the bottom of the drum 330 and the filter unit 350 is connected to the bottom of the hub 340 will be described as follows.

Figure 8:
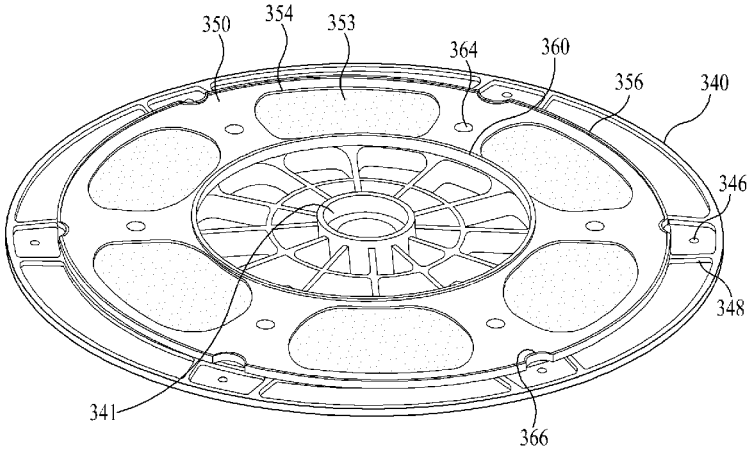
FIG. 8 is a perspective diagram of a hub shown in FIG. 7 and a filter unit according to one embodiment.
Figure 9:
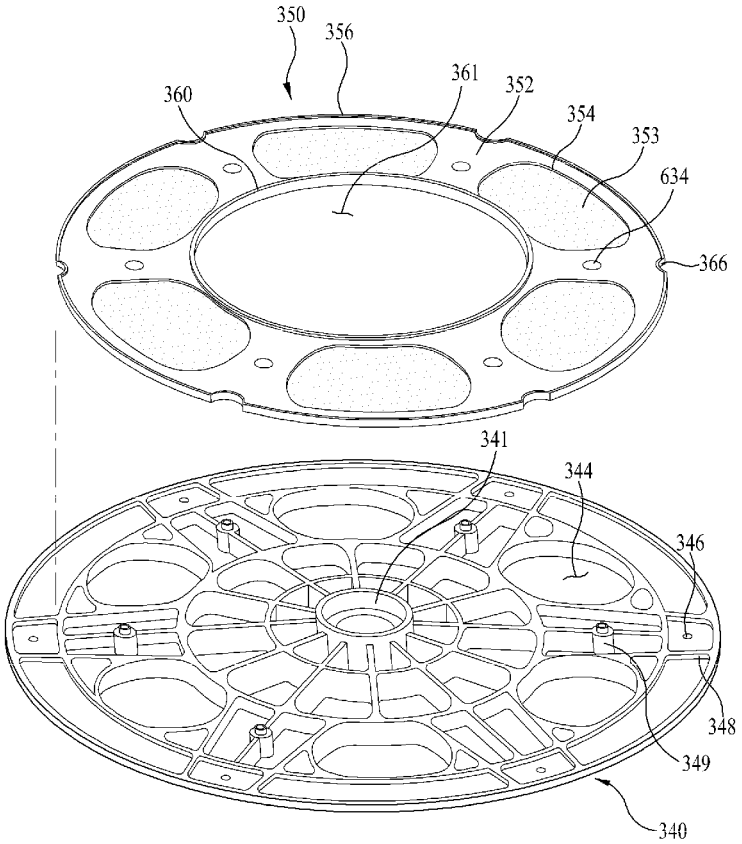
FIG. 9 is an exploded perspective diagram of FIG. 8.

FIG. 8 is a perspective diagram of a hub shown in FIG. 7 and a filter unit according to one embodiment. FIG. 9 is an exploded perspective diagram of FIG. 8. FIGS. 8 and 9 show that the filter unit and the hub are reversed for description convenience sake.

Referring to FIGS. 8 and 9, the hub 340 is connected to the bottom of the drum and the hub 340 is connected to a shaft of the motor to rotate the drum along a rotating shaft. In other words, the hub 340 is connected to both the shaft of the motor and the drum. Specifically, the hub 340 includes a hole 341 formed in a central portion for the shaft of the motor to penetrate a gear portion engaging with the shaft is provided in the hole 341. Accordingly, the hub 340 can be rotated along the rotation of the shaft. Much load is applied to the hole 341 by the rotation of the shaft and a plurality of ribs may be provided in an outer portion along the hole 341. Meanwhile, a plurality of coupling holes 346 for connecting the hub 340 to the drum may be provided in an outer circumferential portion of the hub 340. Coupling members such as bolts are coupled to the bottom of the drum via the coupling holes 356, only to connect the hub 340 and the drum with each other solidly. A strong force is applied to the portion where the coupling holes are provided by the coupling process of the coupling members and ribs 348 may be provided to reinforce the strength. The rubs 348 may be provided in both sides of the coupling hole, respectively. Moreover, open portions 344 communicating with open portions (336, see FIG. 10) provided in the bottom of the drum may be provided in the hub 340. The washing water or rinsing water flowing to the bottom of the drum may be re-drawn into the drum via the open portions 344 of the hub and the open portions 336 of the drum. Accordingly, the number of the open portions 344 formed in the hub 340 may be corresponding to the number of the open portions 336 formed in the drum. Also, the size of the open portion formed in the hub may be corresponding to the size of the open portion formed in the drum, while the positions of the open portions formed in the hub are corresponding to the positions of the open portions formed in the drum. However, the number of the open portions formed in the hub is not necessarily corresponding to that of the open portions formed in the drum and the size of the open portions formed in the hub can be different from that of the open portions formed in the drum. Alternatively, the positions of the open portions formed in the hub may be different from the positions of the open portions formed in the drum. For example, each open portion formed in the hub may be partially overlapped with the corresponding one formed in the drum.

The filter unit 350 may be provided in the bottom of the hub 340. In other words, when the washing apparatus is seen from the top, the drum 330, the hub 340 and the filter unit 350 may be arranged in order in this embodiment. The filter unit 350 includes a body 352 and the body 352 has an approximately cylindrical shape and includes a first open portion 361 the shaft of the motor penetrates. Meanwhile, a plurality of second open portions 354 may be provided along the body 352, corresponding to the open portions 344 of the hub mentioned above, only to form a circulation path in which washing water or rinsing water is circulated. Accordingly, the second open portions 354 of the filter unit 340 are corresponding to the open portions of the hub, with the corresponding sizes and the corresponding positions. However, the number of the second open portions 354 formed in the filter unit 340 may not be necessarily corresponding to the number of the second portions 344 formed in the hub and the sizes of the second open portions 354 formed in the filter unit 340 may be different from the sizes of the second open portions 344 formed in the hub. Also, the second open portions 354 of the filter unit 340 and the second open portions 344 of the hub 340 are positioned differently. For example, each open portion may be partially overlapped with the corresponding one. A filter 353 may be provided in the second open portion 354 to filter the circulating washing or rinsing water. The washing or rinsing water drawn into the drum from the bottom of the drum by the rotating pulsator may pass the filter 353 and the foreign substances such as lint may be prevented from being drawn into the drum again.

Meanwhile, a coupling hole 364 may be provided in a predetermined portion of the body 352 to couple the body 352 to the hub 340. As shown in the drawings, the coupling hole 364 may be provided between the second open portions 354. Also, a coupling boss 349 may be provided in the hub 340, corresponding to the coupling hole 364 of the body 352. In other words, the coupling boss 349 projected a predetermined length may be provided in a predetermined portion of the hub 340 and the coupling hole 364 of the body 352 is positioned to correspond to the coupling boss 349 and a bolt is provided to couple the filter unit 350 to the hub 340. In this instance, the coupling boss 349 is projected a predetermined length to form a predetermined gap between the filter unit 350 and the hub 340. Alternatively, a boss may be formed in the body 352 of the filter unit 350, with a predetermined length. In this instance, the coupling hole 364 of the body 352 may be formed in the boss as shown in FIGS. 8 and 9 and the boss may be projected from the body 352 toward the hub 340. Accordingly, the filter unit 340 may include a first path connected with the inside of the drum 330 via the filter 353 and a second path connected with the inside of the drum 330 via the gap. The first and second paths form independent paths and they are distinguished from each other. Here, the functions of the gap formed between the filter unit 350 and the hub 340 will be described in detail later.

Meanwhile, a rib may be provided in the body 352 to reinforce the strength of the filter unit 350. In other words, the body 352 may include at least one of a first rib 356 provided in an outer circumference of the body 352 and a second rib 360 provided along an inner circumference of the body 352. The first rib 356 and the second rib 360 may be provided along the body 352 to reinforce the strength of the body 352. When the body 352 is connected to the hub, the deformity of the body may be prevented. However, the first rib 356 and the second rib 360 mentioned above are provided not in a surface facing the hub 340 but the other outer surface (the opposite surface) of the body 352. In other words, the filter unit 350 is reversed in FIGS. 8 and 9 such that the hub 340 is provided lower and the first rib 356 and the second rib 360 may be provided on the body 352. If they are provided in the surface facing the hub 340, the first rib 356 and the second rib 360 could act as flow resistivity of the water drained from the drum in a draining step. If the first rib and the second rib act as the flow resistivity, drainage efficiency could be deteriorated and the foreign substances contained in the water may be submerged in the first rib and the second rib. To solve the problem, the first rib 356 and the second rib 360 may be provided in the outer surface of the body 352, not the surface facing the hub 340.

Meanwhile, an evasion groove 366 may be provided in the body 352, corresponding to the coupling hole 346 for connecting the hub 340 to the drum 330. The evasion groove 366 may be provided in a predetermined position corresponding to the position of the coupling hole 346 of the hub 340 along an outer circumference of the body 352. The number of the evasion grooves 366 may be corresponding to the number of the coupling holes. That is to prevent bolts or bolt coupling tools from contacting with the body 352 of the filter unit 350 in the process of coupling the hub 340 to the drum 330. Accordingly, in the washing apparatus according to this embodiment, the hub 340 and the filter unit 350 are connected with each other first when they are coupled to the bottom of the drum and an assembly configured of the hub 340 and the filter unit 350 is fabricated as shown in FIG. 8. After that, the assembly is connected to the bottom of the drum 330.

In case the filter assembly 340 mentioned above is connected to the bottom of the drum 330, the path of the washing water and the rinsing water will be described in detail as follows.

Figure 10:
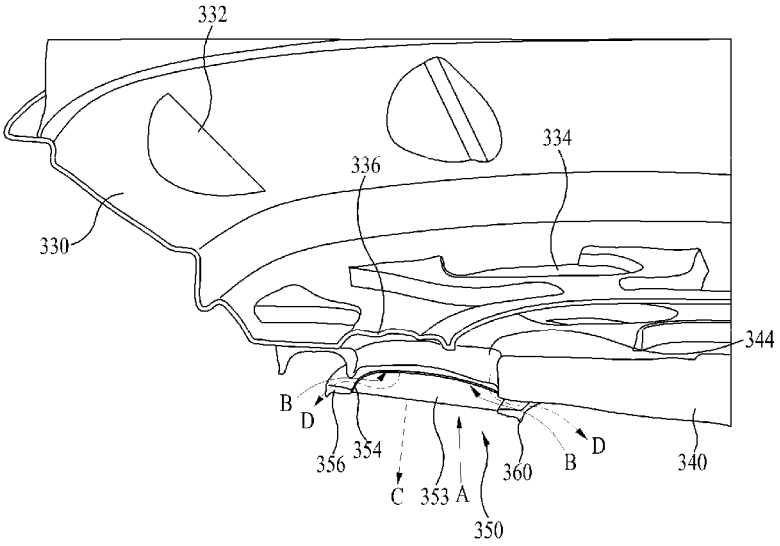
FIG. 10 is a sectional diagram partially illustrating FIG. 7

FIG. 10 is a sectional diagram partially illustrating the bottom of the drum in the washing apparatus according to this embodiment. In FIG. 10, the pulsator provided in the drum 330 is omitted for the sake of convenient explanation.

Referring to FIG. 10, the hub 340 is connected to an outer bottom portion of the drum 330 and the filter unit 350 is connected to the bottom of the hub 340. Meanwhile, a plurality of projections 332 may be provided in the bottom of the drum 330 and generate flow when the drum 330 is rotated. Also, the projections may reinforce the strength of the drum 330. Recesses 334 are provided even in the bottom of the drum 330 to reinforce the strength of the drum.

As mentioned above, the opening portions 336 of the drum 330, the open portions 344 of the hub 340 and the second open portions 354 of the filter unit 350 may be in communication with each other. Accordingly, when the flow is generated by the rotation of the pulsator, the water between the bottom of the drum 330 and the tub is flowing toward the inside of the drum 330. In this instance, most of the water is drawn into the drum 330 along an arrow of 'A' via the filter 353 of the filter unit 350, the open portion of the hub 340 and the open portion 336 of the drum 330. In other words, the path passing the filter 353 of the filter unit 350, the open portion of the hub 340 and the open portion 336 of the drum 330 along the arrow of 'A' may be the first path mentioned above. Accordingly, the water re-drawn into the drum 330 is filtered by the filter 353 such that the foreign substances such as lint may be submerged under the filter 353. However, the filter 353 might be clogged up with the sediments and even in this instance, the water is flowing along an arrow of 'B' via the gap between the filter unit 350 and the hub 340 such that the circulation may not be stopped but performed smoothly. Here, the path toward the drum via the gap between the filter unit 350 and the hub 340 along the arrow of 'B' may be the second path mentioned above. As mentioned above, the first path (A) and the second path (B) are separately provided and they are separated by the filter unit 350 in this embodiment. When the first path and the second path are provided separately, it may be possible to circulate the water smoothly.

Meanwhile, when the water drawn into the drum from the bottom is filtered as mentioned above, sediments may be generated under the filter 353 by the foreign substances such as lint. Such sediments clog the filter 353 to interrupt the circulation of the water. Accordingly, a method for eliminating the sediments is required. Such the sediments can be eliminated by the controlling of the washing apparatus, without disassembling the washing apparatus. In other words, a spinning cycle or any other cycles may include a step of draining the water. In the water drainage step, the drum can be driven occasionally. However, the pulsator is not driven usually. The water drained from the drum 330 is drained via the lower open portions 336, the open portion 344 of the hub 340 and the filter 353 of the filter unit 350 along an arrow of 'C' such that the sediments submerged under the filter 353 may be separated from the filter 353 by the water drained along the arrow of 'C' and exhausted outside the washing apparatus, together with the drained water. here, the path of the water drained downward via the lower open portions 336, the open portion 344 of the hub 340 and the filter 353 of the filter unit 350 along the arrow of 'C' may be the first path mentioned above. Only a direction of the path of 'C' is different from the path of 'A' of the circulating water drawn into the drum.

However, the water drain along the arrow of 'C' may contain foreign substances such as lint and the foreign substances could be stacked up on the filter 353, in other words, a surface of the filter 353 which faces the drum 330. Such the sediments may be eliminated in a step of draining water. When draining the water, most of the water is drained via the filter 353 along the arrow of 'C' and the other water may be drained along an arrow of 'D'. That is because there is much drained water or the filter 353 acts as a kind of a flow resistivity. Accordingly, some of the other water may be drained via a space on the sides, in other words, a space formed between the filter unit 350 and the hub 340, such that the water drained along the arrow of 'D' may sweep the foreign substances submerged on the filter 353 and drained together with the foreign substances. Also, the path of the water flowing in the space between the filter unit 350 and the hub 340 along the arrow of 'D' may be also the second path. Also, only a direction of the path of the circulating water drawn into the drum is different from 'B' path.

When the gap between the hub 340 and the filter unit 350 is larger by a predetermined value or more, the amount of the water not filtered by the filter is increasing which could be a problem. When the gap between the hub 340 and the filter unit 350 is smaller by a predetermined value or more, there may be an extremely small amount of the water drained via the gap between the hub 340 and the filter unit 350, without filtered by the filter and the foreign substances on the filter cannot be eliminated. Accordingly, the gap between the hub 340 and the filter unit 350 may be set more than the thickness of the sediments which can be deposited on the filter 353, when the washing apparatus is used predetermined times or more. For example, the thickness of the sediments may be set as approximately 2.5 mm to 4 mm, considering the capacity of the washing apparatus.

Meanwhile, the filter unit 350 may be fabricated in various methods. For example, the body 352 including the filter 353 may be injection-molded. In this instance, an inclined portion 351 may be provided in a connected portion between the filter 353 and the body 352. The inclined portion 351 may prevent the sediments from being generated along an edge of the filter 353, when the sediments are stacked up on the filter 353. In other words, when the inclined portion 351 is not provided, the filter 353 and the body 352 meets almost perpendicularly and many types of sediment are generated. To reduce the generation of the sediments, an inclined portion 351 is provided in the connected portion between the filter 353 and the body 352. The inclined portion 351 may be provided at least one of upper and lower portions of the filter 353.

Meanwhile, in the washing apparatus according to the embodiment of FIGS. 7 to 10, the filter unit and the hub are separately assembled. In other words, the filter unit is assembled to the hub first to form a hub-filter unit assembly and the hub-filter unit assembly is connected to the bottom of the drum. However, in case the filter unit and the hub are connected to the drum, the embodiment is not limited to that method and the filter unit and the hub may be connected to the drum simultaneously. In other words, a first coupling hole is provided in the filter unit and a second coupling hole is provided in the hub, corresponding to the first coupling hole, such that the hub may be connected to the drum by a bolt penetrating the first through hole and the second through hole.

Figure 11:
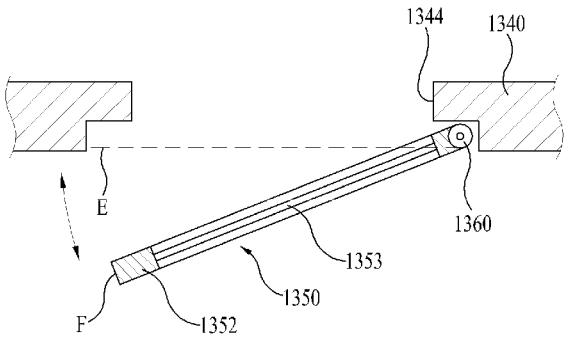
FIG. 11 is a sectional diagram of a filter unit according to a second embodiment.

FIG. 11 is a sectional diagram of a filter unit according to a second embodiment. The filter unit 1350 according to this embodiment which will be described as follows may be directly provided in a hub 1340, which is different from the embodiment described above. The difference will be described as follows.

Referring to FIG. 11, a type of a check valve 1352 configured to be open in one direction may be provided in an open portion 1344 of the hub 1340. The check valve 1352 may be rotatable by a shaft 1360 and a filter 1353 is provided in the check valve. Here, the check valve 1352 is open when the water is drained from the drum and closed when the water is drawn into the drum from the bottom. Accordingly, when the water is drawn into the drum from the bottom of the drum by the driving of the pulsator, the check valve 1352 is closed at a position of 'E' and the water may be drawn into the drum from the outside via the filter 1353 such that the water drawn into the drum after circulating may be filtered by the filter 1353 to prevent foreign substances such as lint from being drawn into the drum again. Meanwhile, when the water is drained from the drum, the check valve 1352 is open at a position of 'F' by the flow of the water, only to be drained smoothly. In addition, a predetermined amount of the drained water is drained via the filter 1353 and the foreign substances deposited on the filter 1353 may be eliminated.

Figure 12:
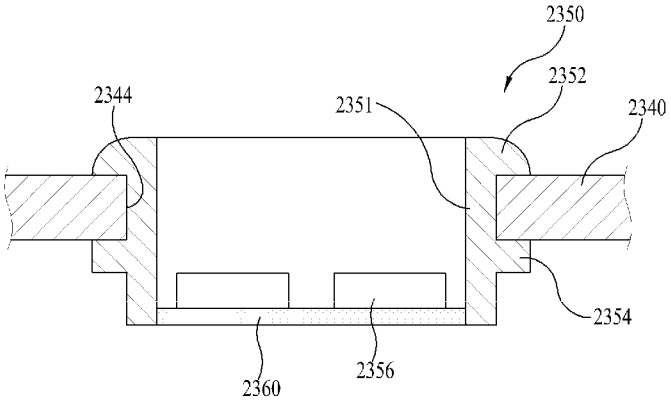
FIG. 12 is a sectional diagram of a filter unit according to a third embodiment.

FIG. 12 is a sectional diagram of a filter unit according to a third embodiment. The filter unit which will be described according to this embodiment may be detachably provided in an open portion of a hub, which is a different feature from the embodiments described above. The difference will be described as follows.

Referring to FIG. 12, the filter unit 2350 according to this embodiment may be provided in an open portion 2344 of the hub 2340. In other words, a plurality of filter units 2350 detachably provided in open portions 2344 of the hub 2340, respectively. Accordingly, the filter units 2350 may be provided in the open portions 2344 of the hub 2340, respectively, or only a predetermined number of the open portions 2344 of the hub 2340. That is variable appropriately.

The filter unit 2350 according to this embodiment include a body 2351 and the body 2351 may include a hooking portion 2352 detachably connected to the open portion 2344, such that a worker can insert the filter unit 2350 in the open portion 2344 with a predetermined pressure to make the hooking portion 2352 hooked to an inner circumference of the open portion 2344 to fix the filter unit 2350. In addition, the body 2351 may include a projection 2354 to fix the filter unit 2350 to the hub 2340. The distance between the hooking portion 2352 and the projection 2354 may be corresponding to the thickness of the hub 2340. Accordingly, when fixing the filter unit 2350, an inner circumference of the open portion 2344 of the hub 2340 may be inserted fixed between the hooking portion 2352 and the projection 2354.

Meanwhile, a filter 2360 may be provided in an end of the body 2351 that is opposite to the hooking portion 2352 and an open portion 2356 may be provided adjacent to the filter 2360. Here, the open portion 2356 may be corresponding to the gap between the hub and the filter unit shown in FIG. 10 as mentioned above. In other words, when the water is drawn into the drum from the bottom, the filter 2360 is clogged with sediments and then the water may be drawn into the drum via the open portion 2356. Also, when the wear is drained from the drum, the drained water may eliminate the sediments deposited under the filter 2360 and some of the drained water may be drained via the open portion 2356, only to eliminate the sediments which might be deposited on the filter 2360.

A control method of the washing apparatus according to one embodiment of the present invention will be described in detail as follows.

In a conventional pulsator type washing apparatus, washing objects are treated through a washing cycle, a rinsing cycle and a spinning cycle. The washing cycle may include a water supply step for supplying washing water, a detergent dissolving step for dissolving detergent in the water and a washing step for separating foreign substances from the washing objects. The rinsing cycle may include a water drainage step for draining the washing water, a dehydrating step for separating the washing water from the washing object and a water supply step for re-supplying washing water to rinse the washing objects. The spinning cycle may include a water drainage step for draining the washing water and a spinning step.

In the detergent dissolving step, the washing step and the rinsing step of the washing-rinsing-spinning cycle, pulsator agitating performance may dissolve the detergent rinse the laundry while separating foreign substances from the washing objects. If such the pulsator agitating is performed continuously, friction between the washing objects and friction between the washing objects and the pulsator may cause wear and tear of the washing objects, such that it is likely to generate lint.

To reduce the wear and tear of the laundry while maintaining the washing performance for the laundry and to exhaust the generated lint effectively, the control method according to this embodiment is proposed. Especially, the control method according to this embodiment can be applied to the washing cycle, the rinsing cycle and the spinning cycle. For example, the control method may be applied when a rinsing cycle provided in one of courses selected by the user is performed and when only a rinsing cycle is performed independently.

Meanwhile, in a control method of the rinsing cycle which will be described as follows, a water level of rinsing water may be an important element as well as the rotation of the drum 30 and/or the pulsator 40. Accordingly, the water level of the rinsing water will be described first and the control method later.

Figure 13:
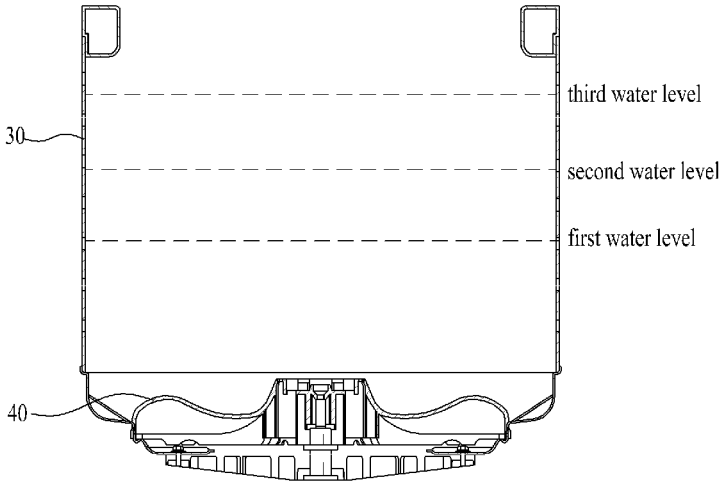
FIG. 13 is a diagram illustrating a water level inside the drum according to the embodiments.

FIG. 13 is a diagram illustrating a water level inside the drum according to the embodiments described above. The structure of the drum is similar to that of the drum according to the embodiments described above and repeated description will be omitted.

Referring to FIG. 13, a rinsing cycle according to the control method of this embodiment may have different rinsing water levels in steps. For example, the rinsing water levels may include a first water level, a second water level and a third water level.

Here, in the first water level, the ratio of the rinsing water to the laundry amount is approximately 1 (the laundry amount, kg): 11~12 (the rinsing water, 1). In the second water level, the ratio is approximately 1:16~17. In the third water level, the ratio is approximately 1:20~21. The first water level may be corresponding to a level of the rinsing water supplied when the conventional rinsing cycle is performed. When the rinsing water is supplied to the second water level and the third water level, more rinsing water is supplied than the rinsing water supplied in the conventional rinsing cycle. When more rinsing water is supplied, the drum can receive more rinsing water and provide a space in which clothes as washing objects can be spread. In other words, in case the flow is generated in the rinsing water by the driving of the drum or the pulsator, the clothes may be spread in the rinsing water. When the clothes are unfolded in the rinsing water, the foreign substances including lint pressed in folded areas can be separated from the clothes.

Figure 14:
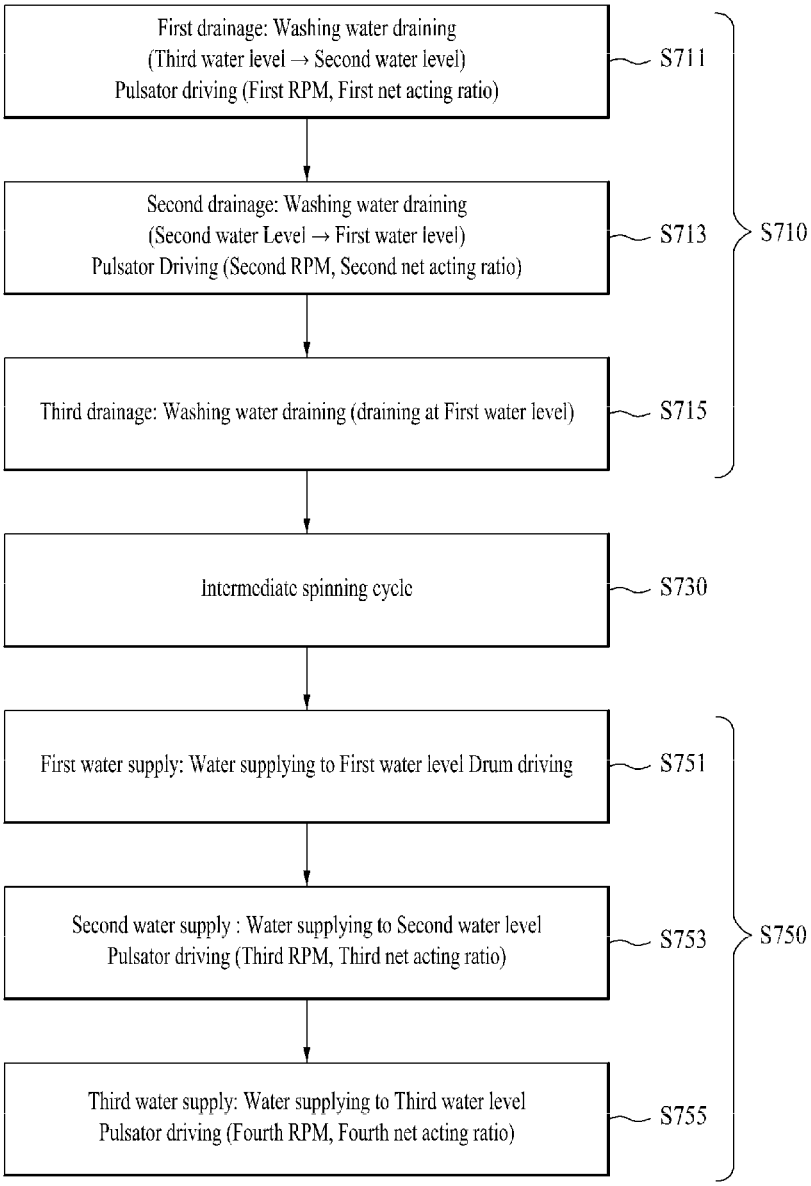
FIG. 14 is a flow chart illustrating a control method according to one embodiment of the present invention.

FIG. 14 is a flow chart illustrating a control method according to one embodiment of the present invention, especially, a control method for a rinsing cycle.

Referring to FIG. 14, a rinsing cycle in the control method according to one embodiment may include a water drainage step (S710) having a plurality of steps for raining a predetermined amount of washing water, respectively, an intermediate spinning step (S730) and a water supply step (S750) having a plurality of steps for supplying a predetermined amount of washing water, respectively.

In the rinsing cycle of the control method which will be described as follows, each of the water drainage steps and the water supply steps may not perform water drainage and water supply continuously but perform water drainage and water supply as much as a predetermined amount of the rinsing water step by step. At least one of the drum and/or the pulsator is driven in each of the steps provided in the water drainage step and the water supply step. When the drum and/or the pulsator are driven, at least one of the rotation number and rotation time (or a net acting ratio) may be set differently. The amount of the water drained in the water drainage step may be substantially identical to or different from the amount of the water supplied in the water supply step. Accordingly, water levels of the rinsing water inside the drum in the steps provided in the water drainage step and the water supply step, the flow of the rinsing water generated by the driving of the drum or pulsator are differentiated such that the rinsing performance can be enhanced, while eliminating the foreign substances such as lint effectively. The control method will be described more specifically as follows.

The water drainage step (S710) may include a plurality of steps, for example, a first drainage step (S711), a second drainage step (S712) and a third drainage step (S715). In at least one of the steps provided in the water drainage step (S710), at least one of the drum and the pulsator may be driven to separate foreign substances attached to the clothes and a predetermined amount of rinsing water is drained to exhaust the foreign substances outside the drum. In case the pulsator is driven in at least one of the steps provided in the water drainage step (S710), at least one of the rotation number (RPM) of the pulsator and a net acting ratio of the driving time (a ratio of the driving time in the overall time) may be set differently. Here, the net acting ratio of the driving time may be defined as the ratio of the driving time to the overall driving time of the motor. For example, when the overall driving time of the motor is 10 seconds, the motor is on for 8 seconds and off for 2 seconds such that the net acting ratio of the motor driving time may be defined as 8 second (or 80%).

Specifically, a control unit controls to drain a predetermined amount of the rinsing water in the first drainage step (S711) and to drive the pulsator at a first RPM according to a first driving time net acting ratio. Here, a level of the rinsing water in the first drainage step (S711) is lowered from a third water level to a second water level. Accordingly, the rinsing water corresponding between the third water level and the second water level in the first drainage step (S711). Mean while, in case a washing cycle provided in one course is performed prior to a rinsing cycle, a step of supplying washing water to the third water level may be provided at the end of the washing cycle. The level of the rinsing water inside the drum in an early period of the rinsing cycle may be corresponding to the third water level.

In the first drainage step (S711), the control unit controls to drive the pulsator at a first RPM according to the first driving time net acting ratio, for example, to be on at 170 RPM for 1 second and off for 0.5 second. As mentioned above, the rinsing water is drained from the third water level to the second water level in the first drainage step such that relatively much rinsing water is supplied inside the drum in the first drainage step, compared with the other steps. In this instance, if the driving time net acting ratio of the pulsator is increased, the flow generated by the driving of the pulsator may spread the clothes in the rinsing water and then the foreign substances including lint contained in folded areas of the clothes may be separated from the clothes. Also, the foreign substances separated from the clothes are moving toward the drum by the flow generated by the driving of the pulsator to be exhausted outside the drum via the holes formed in the drum. Accordingly, the driving time net acting ratio may be set highest in the initial step having the largest amount of the rinsing water inside the drum, out of the steps possessed by the water drainage step. In addition, the steps possessed by the water drainage step are performed and the rinsing water is drained and then the driving time net acting ratio of the pulsator is lowered.

Meanwhile, in the second drainage step (S713), the control unit controls to drive the pulsator at a second RPM according to a second driving time net acting ratio, while controlling to drain the rinsing water as much as a predetermined amount. Here, a level of the rinsing water is lowered from the second water level to the first water level in the second drainage step (S713). Accordingly, the rinsing water is drained to a predetermined value between the second water level and the first water level in the second drainage step (S713).

In the second drainage step (S713), the control unit may drive the pulsator to be on at 160 RPM for 0.8 second and to be off for 0.5 second, or drive the pulsator at the same RPM according to the same driving time net acting ratio as the first drainage step. The amount of the rinsing water in the second drainage step is smaller than that of the rinsing water in the first drainage step and it can be said that the second drainage step has the relatively large amount of the rinsing water, compared with amount of the rinsing water in the other steps. Accordingly, even in the second drainage step, the pulsator is driven at the same RPM and according to the same net acting ratio as in the first drainage step, such that similar effects to the first drainage step can be gained in the second drainage step.

The second drainage step, a step for preparing the intermediate spinning step (S730), which will be described in detail later, may be provided. In other words, to perform the intermediate spinning step, it is important to disperse clothes inside the drum relatively uniformly. Compared with the rinsing step, in the spinning step, the rotation number of the drum is relatively fast. If the eccentric mass is increased by the clothes massed in one area inside the drum, the rotation number of the drum cannot be heightened. Accordingly, the second drainage step, the foreign substances are eliminated from the clothes and the laundry is dispersed within the drum simultaneously. in this instance, the pulsator may be driven at a different RPM and a different driving time net acting ratio from the first RPM and the first driving time net acting ratio in the first drainage step. For example, the pulsator may be set to be on at 160 RPM for 0.8 second and off for 0.5 second.

Hence, in the third drainage step (S715), the control unit controls to drain all of the rinsing water inside the drum from the first water level. Meanwhile, the pulsator may be driven in the third drainage step (S715), so as to prepare the following intermediate spinning step (S730). In other words, in the intermediate spinning step, the rotation number of the drum is relatively high and it is important to disperse the laundry inside the drum uniformly. In the third drainage step, the amount of the rinsing water inside the drum is relatively small, compared with the other steps possessed by the water drainage step. When the pulsator is driven in a state where a small amount of rinsing water is supplied, the clothes inside the drum are massed in a predetermined area and the eccentric mass can be heightened. Accordingly, the pulsator and the drum are not driven and only drainage is performed in the third drainage step such that only the drainage can eliminate the foreign substances floating on the rinsing water and the foreign substances between the drum and the tub.

In the intermediate spinning step (S730), the control unit may rotate the drum at a predetermined rotation number of more and eliminate the moisture from the clothes. Such the spinning step is well-known in the art to which the present invention pertains and detailed description of the spinning step will be omitted.

Next to the intermediate spinning step, the water supply step (S750) is performed.

The water supply step (S750) may include a plurality of steps, for example, a first water supply step (S751), a second water supply step (S753) and a third water supply step (S755). In at least one of the steps provided in the water supply step (S750), at least one of the drum and the pulsator may be driven to separate foreign substances attached to the clothes and the foreign substances are exhausted outside the drum by the flow of the rinsing water.

Meanwhile, if the foreign substances exhausted outside the drum are re-drawn into the drum, the foreign substances may be a trouble to solve because the holes provided in the drum is toward the outside from the inside of the drum. When the drum is molded, the holes are formed by punching from an inner surface toward the outside. When magnifying and seeing a cross section of the through hole, the through hole has a funnel shape toward the outside from the inside of the drum. When the pulsator is driven, the flow of the washing water or rinsing water is the same as shown in FIG. 6. In the washing apparatus according to the embodiment of FIGS. 7, 11 and 12, a filter unit is provided in a predetermined portion of the drum along a circulation path and the filter unit filters the foreign substances including lint, in case the exhausted washing or rinsing water is re-drawn into the drum via the space between the drum and the tub, such that the lint may be prevented from being drawn into the drum again. The washing apparatus according to the embodiments mentioned above may include at least one of the filter unit and the through hole formed in the drum. It is difficult for the foreign substances exhausted outside the drum to be drawn into the drum again via the through hole, such that the foreign substances may be exhausted outside the drum and the foreign substances stuck between the drum and the tub may be drained outside the washing apparatus in the water drainage step performed in succession, together with the drained rinsing water.

As mentioned above, at least one of the steps provided in the water supply step (S750) may drive the pulsator. When the pulsator is driven, at least one of the rotation number (RPM), the driving time net acting ratio (the ratio of the driving time to the overall driving time) may be set differently in the steps provided in the water supply step.

Specifically, in the first water supply step (S751), the control unit controls to rotate the drum in one direction or in both directions, while supplying a predetermined amount of rinsing water. In other words, in the first water supply step (S751), the rinsing water is supplied to a first water level and only the drum is driven, not the pulsator. Once the former intermediate spinning step finishes, the clothes inside the drum stuck to an inner wall of the d rum may be dispersed. Specifically, the drum is rotated at a high rotation number in the intermediate spinning step and the clothes are tangled in close contact with the inner wall of the drum by the centrifugal force once the intermediate spinning step is completed. Accordingly, in the first water supply step, rinsing water is supplied and simultaneously the drum is rotated in one direction or both directions to drop the laundry from the inner wall of the drum to disperse the laundry. Also, even in the first water supply step, foreign substances may be exhausted outside the drum by the rotation of the drum.

Hence, in the second water supply step (S753), the control unit may drive the pulsator at a third RPM according to a third driving time net acting ratio, while supplying a predetermined amount of rinsing water. Here, a level of the rinsing water in the second water supply step (S753) is heightened from a first water level to a second water level. The rinsing water is supplied to a predetermined value between the first water level and the second water level in the second water supply step (S753).

In the second water supply step (S753), the control unit may drive the pulsator to be on at 160 RPM for 0.8 second and off for 0.5 second, or at the same RPM and according to the same driving time net acting ratio as the first drainage step mentioned above, for example. Even though reaching a third water level, the amount of the rinsing water in the second water supply step is relatively large, compared with the other steps. Accordingly, the pulsator may be driven at the first RPM and according to the first driving time net acting ratio mentioned above even in the second water supply step. In this instance, the clothes are spread in the rinsing water by the flow generated by the driving of the pulsator such that the foreign substances attached to folded areas of the clothes may be separated from the clothes. The foreign substances separated from the clothes are flowing toward the drum by the flow generated by the driving of the pulsator and exhausted outside the drum via the holes formed in the drum.

As the steps of the water supply step are performed and the amount of the rinsing water inside the drum is getting larger, the driving net acting ratio of the pulsator may be getting higher. Accordingly, the driving time net acting ratio of the pulsator may be set highest in the last step having the largest amount of the rinsing water inside the drum, out of the steps of the water supply step. Like the first water supply step mentioned above, in the second water supply step may disperse the clothes inside the drum. In this instance, the pulsator may be set to be at 160 RPM for 0.8 second and to be off for 0.5 second, for example.

Hence, in the third water supply step, the control unit may drive the pulsator at a fourth RPM according to a fourth driving time net acting ratio. Here, a level of the rinsing water in the third water supply step (S755) is heightened from the second water level to the third water level. The rinsing water corresponding to a value between the second water level and the third water level may be supplied in the third water supply step (S755).

In the third water supply step, the control unit may drive the pulsator at the fourth RPM according to the fourth driving time net acting ratio, for example, to be on at 170 RPM for 1 second and to be off for 0.5 second. In other words, the rotation number and the driving time of the pulsator in the third water supply step may be the same as in the first drainage step mentioned above. That is similar to the description of the first drainage step. In the third water supply step, the relatively more rinsing water inside the drum is supplied, compared with the amount of the rinsing water supplied in the other steps. In this instance, when the driving time net acting ratio of the pulsator is heightened, the clothes are spread in the rinsing water by the flow generated by the driving of the pulsator such that the foreign substances contained in folded areas of the clothes may be separated from the clothes. In addition, the foreign substances detached from the clothes are flowing toward the drum by the flow generated by the driving of the pulsator, to be exhausted outside the drum via the through holes of the drum.

Meanwhile, the water drainage step (S710), the intermediate spinning step (S730) and the water supply step (S750) may be performed one time. However, they may be repeatedly performed to enhance the performance of the rinsing cycle and to exhaust the foreign substances.

INDUSTRIAL APPLICABILITY

As described above, the washing apparatus according to the embodiments of the present invention may eliminate the foreign substances generated in the washing process effectively by preventing the foreign substances including lint drained outside the drum from being drawn into the drum again.

Furthermore, the control method according to the embodiments of the present invention may drain or supply a predetermined amount of water in the water drainage step and in the water supply step gradually. In addition, at least one of the pulsator and the drum may be driven in each of the steps provided in the water drainage step and the water supply step and exhaust the foreign substances from the inside of the drum.

What is claimed is:

1. A method for controlling a washing apparatus comprising a drum and a pulsator which are rotatable independently, the method comprising:

a water drainage step comprising a plurality of steps configured to drain rinsing water sequentially by a predetermined amount; and then, an intermediate spinning step following the plurality of steps of the water drainage step; and then, a water supply step following the intermediate spinning step comprising a plurality of steps configured to supply rinsing water sequentially by a predetermined amount, wherein in at least one of the steps provided in the water drainage step or the water supply step, at least one of the drum or pulsator is driven, and wherein a driving time net acting ratio (a ratio of the driving time to the overall time) of the drum or pulsator is set different for each of the plurality of steps of the water drainage step or the water supply step.

2. The method for controlling the washing apparatus according to claim 1, wherein in at least one of the steps provided in the water drainage step, at least one of the drum and pulsator is driven to separate foreign substances from clothes and the foreign substances are exhausted from the drum simultaneously to be drained together with the rinsing water.

3. The method for controlling the washing apparatus according to claim 2, wherein at least one of the steps provided in the water drainage step, the pulsator is driven.

4. The method for controlling the washing apparatus according to claim 3, wherein in the steps provided in the water drainage step, the rotation number (RPM) of the drum or the pulsator is set different for each of the plurality of steps of the water drainage step or the water supply step.

5. The method for controlling the washing apparatus according to claim 1, wherein in an initial step of the steps provided in the water drainage step, the driving time net acting ratio of the pulsator is the highest in comparison to the driving time net acting ratio of the drum.

6. The method for controlling the washing apparatus according to claim 1, wherein the driving time net acting ratio of the pulsator is getting lower, as the steps provided in the water drainage step are performed.

7. The method for controlling the washing apparatus according to claim 1, wherein in a final step, in which a water level is lower than a predetermined water level, of the steps provided in the water drainage step, the pulsator is not driven.

8. The method for controlling the washing apparatus according to claim 1, wherein the amount of the rinsing water drained in each of the steps provided in the water drainage step is the same.

9. The method for controlling the washing apparatus according to claim 1, wherein the amount of the rinsing water drained in each of the steps provided in the water drainage step is different.

10. The method for controlling the washing apparatus according to claim 1, wherein the water drainage step comprises a first drainage step, a second drainage step and a third drainage step in which the rinsing water is drained by a predetermined amount, respectively.

11. The method for controlling the washing apparatus according to claim 1, wherein in at least one of the steps provided in the water supply step, at least one of the drum and pulsator is driven to separate foreign substances from the clothes and simultaneously to exhaust the foreign substances from the drum.

12. The method for controlling the washing apparatus according to claim 11, wherein in an initial step, in which a water level reaches a predetermined water level, out of the steps provided in the water supply step, the drum is rotated to disperse the clothes loaded in the drum.

13. The method for controlling the washing apparatus according to claim 12, wherein the rotation of the drum comprises a one-direction rotation or two-direction rotation.

14. The method for controlling the washing apparatus according to claim 12, wherein in during the steps provided in the water supply step, the pulsator is driven.

15. The method for controlling the washing apparatus according to claim 1, wherein the driving time net acting ratio of the pulsator is getting higher, as the steps provided in the water supply step are getting performed.

16. The method for controlling the washing apparatus according to claim 1, wherein in a final step of the steps provided in the water supply step, the driving time net acting ratio of the pulsator is the highest.

17. The method for controlling the washing apparatus according to claim 1, wherein the amount of the rinsing water supplied in the steps provided in the water supply step is the same.

18. The method for controlling the washing apparatus according to claim 1, wherein the amount of the rinsing water supplied in the steps provided in the water supply step is different.

19. The method for controlling the washing apparatus according to claim 1, wherein the water supply step comprises a first water supply step, a second water supply step and a third water supply step in which the rinsing water is supplied by a predetermined amount.

20. The method for controlling the washing apparatus according to claim 1, wherein the water drainage step, the intermediate spinning step and the water supply step are performed in a rinsing cycle.

* * * * *